United States Patent [19]

Giacopelli

[11] 3,945,909

[45] Mar. 23, 1976

[54] BIPOLAR ELECTRODES AND ELECTROLYTIC CELL THEREWITH

[75] Inventor: Umberto Giacopelli, Rosignano-Solvay, Livorno, Italy

[73] Assignee: Solvay & Cie, Belgium

[22] Filed: Mar. 25, 1974

[21] Appl. No.: 454,552

[30] Foreign Application Priority Data

Mar. 28, 1973 France ..... 73.11713

[52] U.S. Cl. ..... 204/284; 204/254; 204/256; 204/268; 204/286

[51] Int. Cl.[2] ..... B01K 3/06; C01B 11/26

[58] Field of Search ..... 204/254, 255, 256, 268, 204/283, 284, 286

[56] References Cited

UNITED STATES PATENTS

| | | | |
|---|---|---|---|
| 3,563,878 | 2/1971 | Grotheer | 204/286 |
| 3,759,815 | 9/1973 | Larsson | 204/286 |
| 3,761,384 | 9/1973 | Ruthel et al. | 204/286 |
| 3,813,326 | 5/1974 | Gunby | 204/286 |

FOREIGN PATENTS OR APPLICATIONS

| | | | |
|---|---|---|---|
| 1,127,484 | 9/1968 | United Kingdom | 204/266 |

*Primary Examiner*—Howard S. Williams
*Assistant Examiner*—A. C. Prescott
*Attorney, Agent, or Firm*—Robert E. Burns; Emmanuel J. Lobato; Bruce L. Adams

[57] ABSTRACT

The invention relates to a bipolar electrode and to a diaphragm-type electrolyser equipped with such a bipolar electrode. Said bipolar electrode comprises a generally vertical supporting wall, a plurality of generally vertical, spaced parallel anode plates, transversally connected to said wall, on one side thereof, and a plurality of generally vertical, spaced parallel foraminous cathode fingers transversally connected to the opposite side of said wall, and alternating with the anodes. At least a portion of the supporting wall comprises a plurality of generally vertical elongated metallic members supporting the cathode fingers and extending each between two anode plates. The cathode fingers are in communication with one another through apertures provided through said metallic members.

12 Claims, 9 Drawing Figures

BIPOLAR ELECTRODES AND ELECTROLYTIC CELL THEREWITH

BACKGROUND OF THE INVENTION

The present invention relates to improvements to electrolytic cells, especially to cells for the production of chlorine from aqueous solutions of alkali-metal chlorides.

This invention relates more particularly to a bipolar electrode for a diaphragm type electrolyser, said electrode comprising a substantially vertical supporting wall, a plurality of substantially vertical, spaced parallel anode plates, transversely connected to said wall, on one side thereof, and a plurality of substantially vertical, spaced, foraminate cathode fingers, transversally connected to the opposite side of said wall, and alternating with the anodes.

In known bipolar electrodes of this type, for example in the one described in the Belgian Pat. No. 752,380 of June 23, 1970 in the name of PPG INDUSTRIES Inc., the supporting plate is constituted by a steel plate to which the anodes (constituted by titanium plates coated with a catalytic active coating) and the cathodes (hollow cathode fingers having foraminate walls intended to be covered with a diaphragm) are fixed by welding, rivetting or bolting. On the anodic side, the steel plate is coated with a protective layer corrosion resistant to the electrolyte and to the products generated by electrolysis.

The aforesaid known bipolar electrodes present many disadvantages. Their construction is not easy in particular due to the cumbersome supporting plate of generally important sizes. The assembling of anodes and cathodes on said plate is also complicated by the need to have a plate strictly plane and to realize a regular and precise distribution of anodes and cathodes along said plate.

Another important disadvantage of these known bipolar electrodes is the difficulty to handle said electrodes, in particular to diassemble the same, in order, for example, to replace a damaged anode or cathode.

In order to facilitate the assembling of the anodes on the supporting plate and to reduce the electrical resistance of the resulting assembly, the supporting plate is sometimes made of a composite plate constituted by a steel strip and a titanium strip closely joined to each other for example by explosion welding. Then, the titanium anode plates may be easily fixed on the titanium strip. However, it has been noted on practice, that composite titanium-steel plates rapidly deteriorate due to the formation of titanium hydride in the titanium-strip, resulting from the diffusion of hydrogen atoms arising on the cathode surface.

SUMMARY OF THE INVENTION

The present invention overcomes these disadvantages of the aforesaid known bipolar electrodes. It relates, for this purpose, to a bipolar electrode for a diaphragm type electrolyser, said bipolar electrode comprising a generally vertical supporting wall, a plurality of generally vertical, spaced parallel anode plates, transversally connected to said wall, on one side thereof, and a plurality of generally vertical, spaced parallel foraminate cathode fingers, transversally connected to the opposite side of said wall, and alternating with the anodes, wherein at least a portion of said supporting wall comprises a plurality of generally vertical elongated metallic members supporting the cathode fingers and extending each between two anode plates, said cathode fingers being in communication with one another through apertures provided through said metallic members.

An advantage of the electrode according to the invention is its ability to be easily and rapidly assembled and disassembled. Moreover, said electrode can be manufactured from prefabricated elements, assembled together in a more or less great number according to the sizes required for the electrode.

In the bipolar electrode according to the invention, the elongated metallic members of the supporting wall may be steel members coated on the anodic side with a protective coating corrosion resistant to the electrolyte. The anodes are preferably constituted by titanium plates inserted between the elongated steel members, said titanium plates being coated at least partly with a catalytic coating, for example, a conductive coating containing a platinum group metal or a compound of a platinum group metal.

In the aforesaid embodiment of the bipolar electrode according to the invention, it has been noted that there is no formation of titanium hydride in the titanium anodes, what constitutes a further appreciable advantage. Moreover the possibility of imparting a substantially plane shape to said anode plates, greatly facilitates the coating of the plates, for example by means of a painting method.

According to the invention, it is preferred to coat the surfaces of each anode plate which are in contact with the elongated metallic members of the supporting wall, with a coating which is more electro-conductive than titanium, for example with platinum.

The invention relates also to a bipolar type diaphragm electrolyser, comprising at least two unit electrolytic cells, each unit cell including a lateral wall, a plurality of generally vertical, parallel spaced anodes, a plurality of generally vertical, parallel spaced, foraminous cathode fingers alternating with said anodes, a permeable diaphragm covering said foraminous cathode fingers, means for feeding said unit cell with an electrolyte, means for evacuating products generated in the cell, and a partition between said cell and a next adjacent one, wherein said partition between both unit cells comprises a plurality of generally vertical elongated metallic members, disposed side by side, connected to and supporting the cathode fingers of one of both cells, and extending each between a pair of anode plates of the other cell, said cathode fingers being in communication with one another through apertures provided through said metal members.

In a particular form of embodiment of the electrolyser according to the invention, said partition comprises two vertical elongated end members constituting at least a portion of the lateral wall of one of said unit cells.

BRIEF DESCRIPTION OF THE DRAWINGS

Other features and details of the invention will appear from the following description of the attached drawings, which schematically represent, solely by way of example, several forms of embodiment of the bipolar electrode and the electrolyser according to the invention.

DESCRIPTION OF THE PREFERRED EMBODIMENTS

In these figures, the same reference numbers designate same elements.

Figure 1:
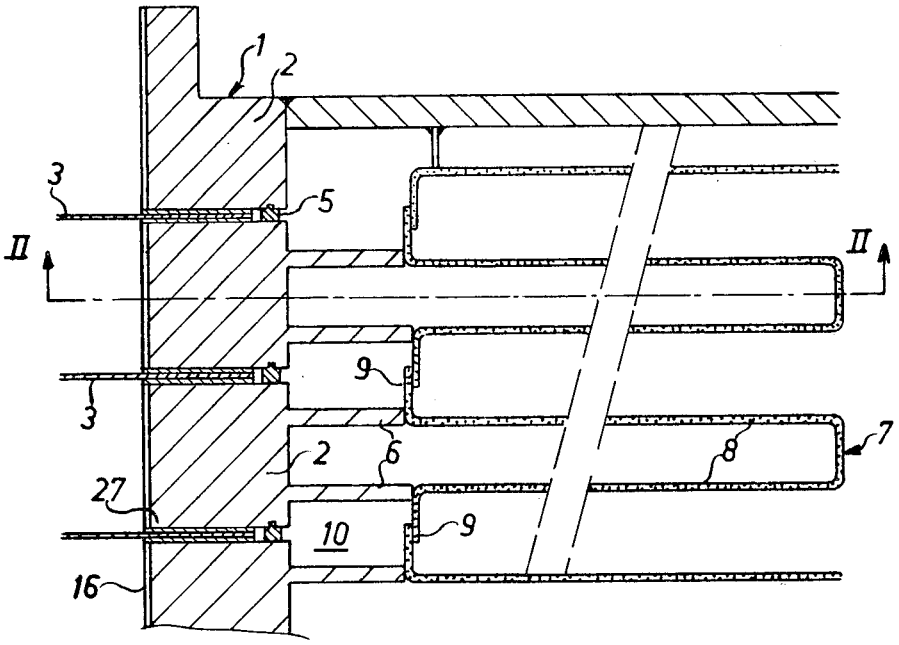
FIG. 1 shows partly, in horizontal cross-section, a first embodiment of the bipolar electrode according to the invention.
Figure 2:
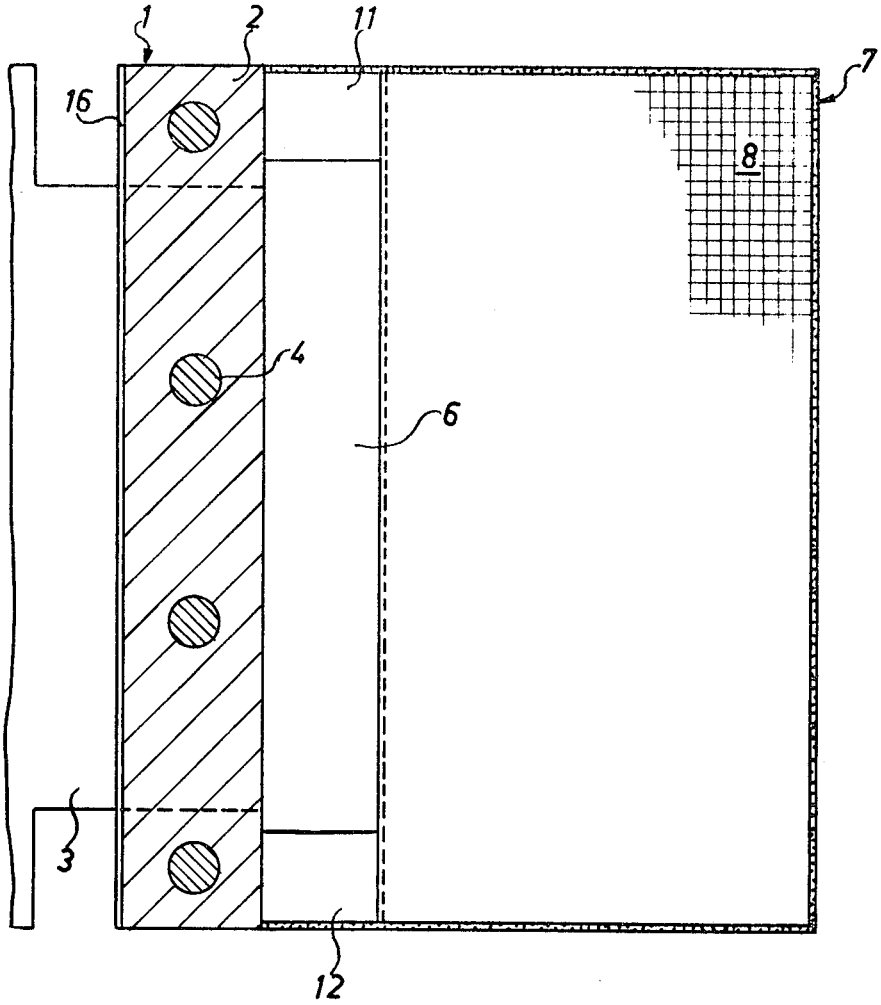
FIG. 2 is a vertical cross-section along the planes II—II of FIG. 1.

In a first embodiment, represented in FIGS. 1 and 2, the bipolar electrode according to the invention, comprises a supporting wall designated by the reference number 1. The supporting wall includes a plurality of vertical elongated members 2, for example made of steel. Anode plates 3 are inserted between the members 2. The anode plates 3 are advantageously titanium plates, each having on at least a portion of its two faces, an electro-catalytic active coating comprising a platinum group metal or a compound of a platinum group metal. The elongated members 2 and the anodes 3 are clamped together by means of a plurality of bolts 4 and nuts (not shown) in order to form a rigid assembly. Sealing joints 5 may be interposed between the elongated members 2 in prolongation of said anodes 3.

Two transversal vertical extensions 6 supporting a foraminate cathode finger 7 are provided on each elongated member 2, on the side opposite to the anodes 3.

The cathode fingers 7 are successively connected with one another by means of foraminate side blades obtained by folding the longitudinal walls 8 of the cathode fingers 7 and applied one against another, preferably elastically.

The cathode fingers 7, their side blades 9 and the elongated members 2 delimite thus a cathode chamber in the bipolar electrode. In order to allow a circulation of the products generated by electrolysis, in the peripheral zone 10 of said cathode chamber, the aforesaid extensions are cut for forming apertures 11 and 12.

The walls of the cathode fingers 7 and their foraminate side blades 9 are intended to be covered with a diaphragm, on the outside of the aforesaid cathode chamber.

The elongated members 2 are coated, on the anode side thereof, with a protective coating 16 which is corrosion-resistant to the electrolyte and chlorine, for example with a layer of concrete containing a chlorine-resistant polyester.

In order to improve the tightness between the anode plates 3 and the elongated members 2 and to reduce the electrical resistance between said anode plates and elongated members, it is advantageous to apply between said anode plates 3 and said elongated members 2, a layer 27 of a known electroconductive and corrosion-resistant cement.

Figure 3:
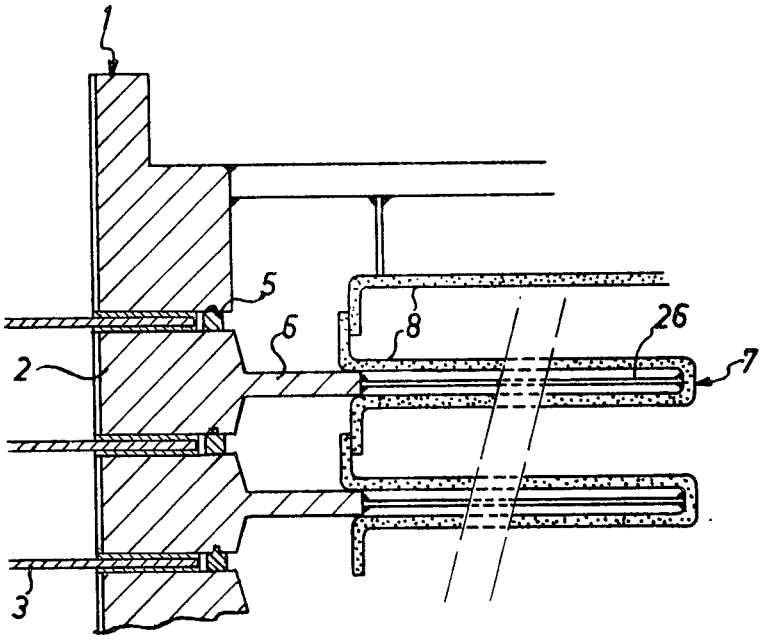
FIG. 3 shows a modification of the embodiment of FIG. 1.

According to a modified embodiment, shown on FIG. 3, each cathode finger 7 is engaged about and attached to an extension 6 of an elongated member 2. In order to reduce the electrical resistance through the cathode fingers 7, they are advantageously provided each with an inner axial plate connected to the upper and lower parts of the cathode finger and to the extension 6 attached to said cathode finger 7.

According to another modified embodiment, not shown, the removable clamping means of the elongated members 2 and anode plates 3 is similar to that described in Belgian Pat. No. 755,900 filed on Sept. 9, 1970. The clamping means comprise a plurality of hollow bolts passing respectively through the elongated members 2 and screwed successively in one another. Each bolt comprises on the one hand a head passing through an elongated member 2 and bearing on a shoulder of said elongated member, and on the other hand, a threaded body screwed in a threaded opening of the head of a next adjacent nut.

Figure 4:
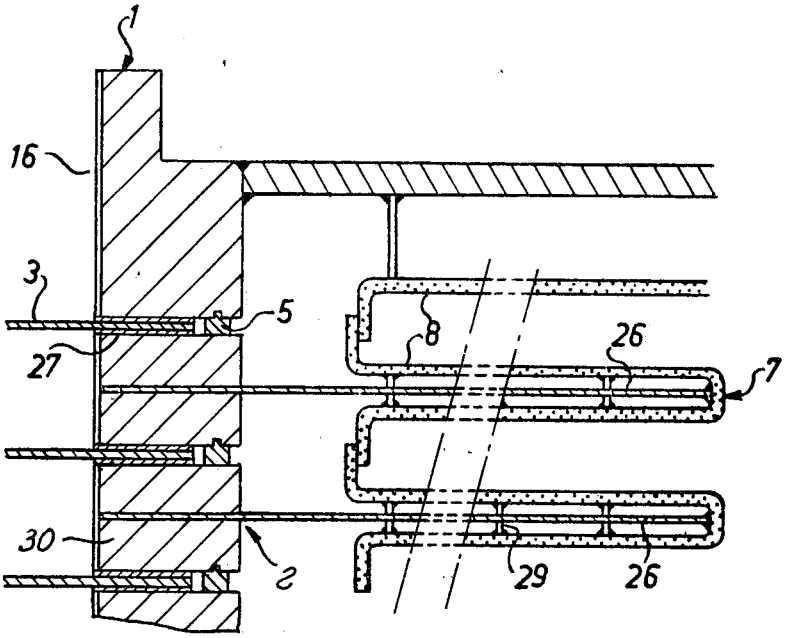
FIGS. 4 to 8 show partly in horizontal cross-section, five other forms of embodiment of the bipolar electrode according to the invention.

In the embodiment of FIG. 4, the cathode fingers 7, similar to those of FIG. 3, are supported on inner axial plates 26 extending between the anode plates 3. Generally vertical metallic elements 30 are interposed and clamped between said plates 26 and anode plates 3. Cross-pieces 29 may be disposed between the axial plates 26 and the longitudinal walls 8 of the cathode fingers in order to reinforce their rigidity.

Figure 5:
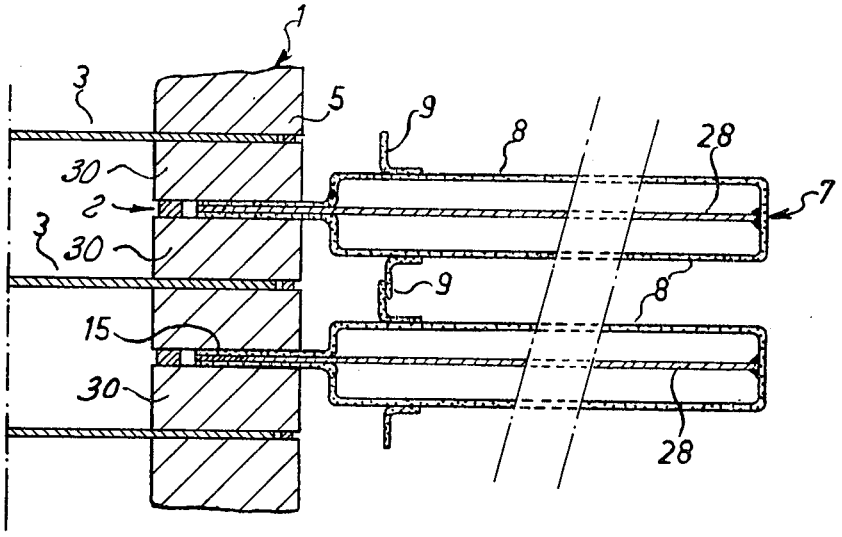

In the embodiment of FIG. 5, both longitudinal vertical walls 8 of each cathode finger 7 are turned back in the vicinity of the supporting wall 1 so as to form a pair of axial extensions 15 inserted and clamped between two vertical elongated elements 30 of the supporting wall 1. The foraminate side blades 9 are directly attached to the foraminate walls 8 of the cathode fingers.

A conductive plate 28 is preferably inserted between the extensions 15 and extends inside the cathode finger 7, in order to facilitate the circulation of the electric current.

Figure 6:
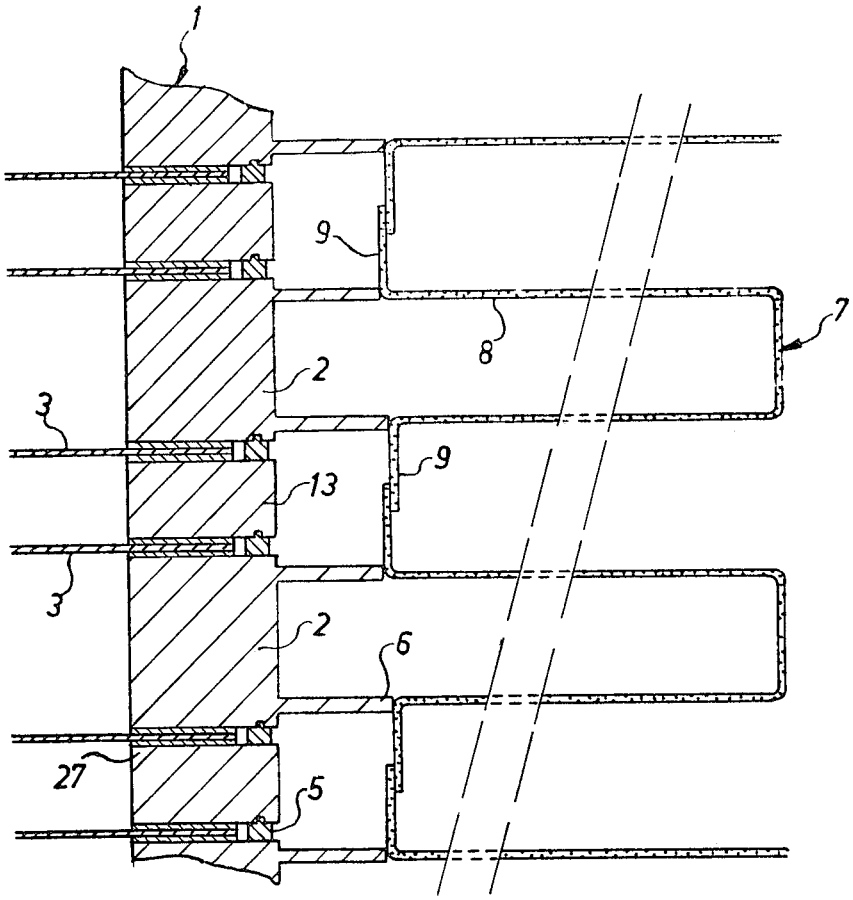

FIG. 6 schematically shows a further embodiment of the bipolar electrode according to the invention. In this embodiment, the anodes are shaped in the form of vertical boxes comprising each a pair of plates 3 disposed on either side of an intermediate vertical element 13. The elements 13 are part of the supporting plate 1, where they alternate with the elongated members 2 carrying the cathode fingers 7 by means of said extensions 6.

In the embodiment of FIG. 6, the portions of plates 3, which are not engaged in the supporting wall 1 may be either foraminate or not.

Figure 7:
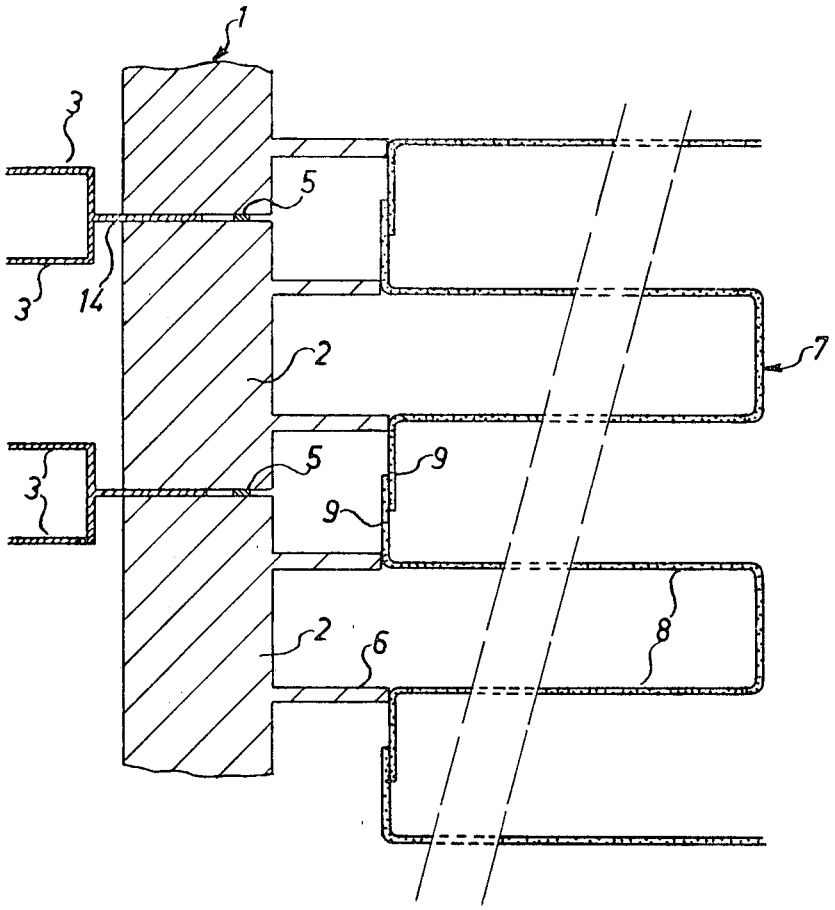

According to a modification, partly shown on FIG. 7, of the embodiment of FIG. 6, the pair of plates constituting each anode box are fixed on the flange of a T-shaped member 14, the web of which is inserted between two elongated members 2 of the supporting wall 1.

Figure 8:
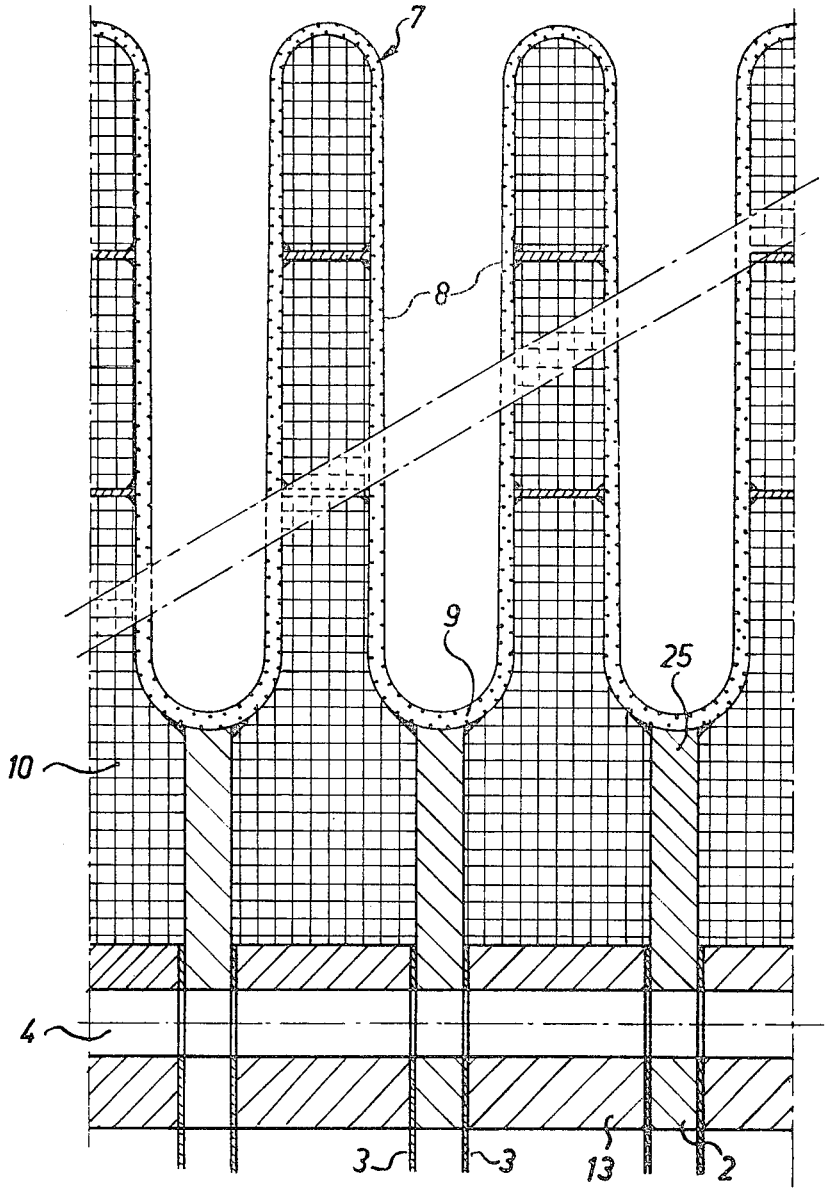

In a preferred embodiment of the invention, represented on FIG. 8, the bipolar electrode has box-like anodes which comprise each a pair of plates 3 disposed on either side of a vertical elongated member 2 of the supporting wall 1. The cathode fingers 7 are prolongated by side blades 9 obtained, for example, by folding the ends of their walls 8. The cathode fingers 7 are fixed coupled to extensions 25 of the vertical elongated members 2, by means of the side blades 9. Each cathode finger 7 is thus carried by two elongated members 2 of the supporting wall 1. Intermediate elements 13 are interposed between the successive pairs of plates 3.

In the bipolar electrode of FIG. 8, the cathode fingers 7 and their respective side blades 9 may be for example built up together from a corrugated foraminate structure.

The embodiment of FIG. 8 presents the advantage to shorten the electric current circuit from the cathodes to the anodes through the supporting wall 1.

Figure 9:
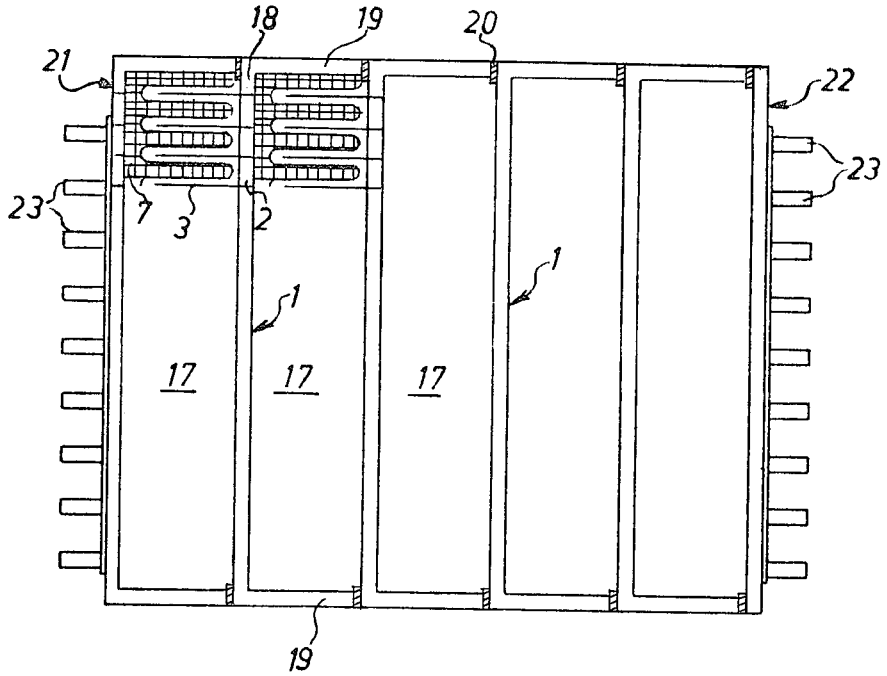
FIG. 9 shows schematically, in horizontal cross-section, a particular embodiment of a diaphragm type electrolyser according to the invention.

FIG. 9 represents schematically in a horizontal section, a preferred embodiment of a diaphragm-type electrolyser according to the invention.

The electrolyser comprises five unit cells 17 separated from each other by transversal vertical partitions, each constituting a supporting wall of a bipolar electrode according to the invention. Each partition or supporting wall comprises, as described hereabove, a plurality of vertical elongated members 2 alternating with vertical anode plates 3 and clamped together with said anode plates. Said vertical elongated members 2 carry cathode fingers 7 made of a wire net and alternating with the anodes 3 of a next adjacent unit cell 17.

According to the invention, the end elongated members 18 of each supporting wall 1 comprises lateral extensions 19 constituting the lateral vertical wall of a unit cell 17 contiguous to the partition 1. Appropriate sealing joints 20 are interposed between said extensions 19 and the next adjacent partitions.

The two end partitions 21 and 22 of the electrolyser are similar to the partitions 1, except that they are unipolar, cathodic and anodic respectively. They are provided with lead-in bars 23.

The transversal partitions 1, end partitions 21 and 22 and lateral walls 19 are tightly mounted on a base (not shown) and covered by a cover (not shown).

The electrolyser of FIG. 9 comprises further means (not shown) for feeding a solution to be electrolyzed in the unit cells and for evacuating products generated in the cells.

Although several preferred forms of embodiment of the invention have been described, with reference to the drawings, it is evident that the invention is not limited to these embodiments, and any modification may be made in the shape, the arrangement and the construction of certain of the elements used in carrying it into effect.

What I claim is:

1. In a bipolar electrode for a diaphragm type electrolyser, a self-supporting, upstanding bipolar electrode structure comprising, in assembled relationship, a generally vertical supporting wall, a plurality of generally vertical, laterally spaced, parallel anode plates, transversally connected to said wall, on one side thereof and extending away therefrom, and a plurality of generally vertical, spaced parallel foraminous cathode fingers, transversally connected to the opposite side of said wall and extending away therefrom, and alternating with the anodes, the improvement which comprises at least a portion of said supporting wall comprising a plurality of apertured generally vertical elongated metallic members supporting the cathode fingers and each extending between two anode plates, said cathode fingers being in communication with one another through apertures provided through said metallic members, and said portion of said wall comprising extensions of the anode plates, alternating with and clamped between the vertical elongated metallic members supporting the cathode fingers to make said portion of said wall continuous and self-supporting on the anode side thereof.

2. An electrode according to claim 1, wherein two elongated metallic members support each cathode finger facing each other and wherein each anode comprises at least a pair of plates facing each other, and disposed on either side of an elongated metallic member connected to two successive cathode fingers.

3. An electrode according to claim 1, wherein each elongated metallic member carries one single cathode finger and is disposed between a pair of anode plates belonging to two separate anodes.

4. An electrode according to claim 1, wherein substantially vertical blades successively connect said cathode fingers to each other in the vicinity of the supporting wall.

5. An electrode according to claim 4, wherein said side blades of successive cathode fingers are foraminate and elastically applied against one another.

6. An electrode according to claim 1, wherein said cathode fingers comprise a corrugated foraminate structure.

7. An electrode according to claim 1, wherein sealing joints are interposed between said successive elongated members in prolongation of said anode plates.

8. An electrode according to claim 1, wherein said elongated members are steel members having a protective corrosion resistant coating on the anode side thereof.

9. An electrode according to claim 1, wherein said supporting wall comprises two vertical, elongated end members having lateral extensions defining a portion of lateral vertical walls of a bipolar type electrolyser.

10. An electrode according to claim 1, including an electrically conductive and corrosion-resistant cement disposed between said anode plates and elongated members.

11. A bipolar electrode for a diaphragm type electrolyser, said electrode comprising, a self-supporting, upstanding bipolar electrode structure comprising, in assembled relationship, a generally vertical supporting wall, a plurality of generally vertical, laterally spaced, parallel anode plates, transversally connected to said wall, on one side thereof and extending away therefrom, and a plurality of generally vertical, spaced parallel foraminous cathode fingers, transversally connected to the opposite side of said wall and extending away therefrom, and alternating with the anodes, at least a portion of said supporting wall comprising a plurality of apertured generally vertical elongated metallic members each supporting one cathode finger and each extending between two anode plates belonging to separate anodes, said cathode fingers being in communication with one another through apertures provided through said metallic members, and each elongated metallic member comprising a generally vertical plate extending axially in the cathode finger carried by said elongated member, and a pair of generally vertical elongated elements sandwiching and clamping said plate.

12. An electrode according to claim 11, wherein a known electroconducting and corrosion-resistant cement is interposed between said anode plates, elongated elements and vertical plates.

* * * * *